US007448142B2

(12) United States Patent
Geier

(10) Patent No.: US 7,448,142 B2
(45) Date of Patent: Nov. 11, 2008

(54) GRIDDED STABILIZER AND METHOD OF USING SAME

(75) Inventor: Catherine R. Geier, Waukesha, WI (US)

(73) Assignee: Patchworks That Praise,, Waukesha, WI (US)

( * ) Notice: Subject to any disclaimer, the term of this patent is extended or adjusted under 35 U.S.C. 154(b) by 394 days.

(21) Appl. No.: 11/330,617

(22) Filed: Jan. 12, 2006

(65) Prior Publication Data

US 2006/0201407 A1 Sep. 14, 2006

Related U.S. Application Data

(60) Provisional application No. 60/660,445, filed on Mar. 11, 2005.

(51) Int. Cl.
*G01B 3/14* (2006.01)
*A41H 3/00* (2006.01)
*D05B 97/00* (2006.01)

(52) U.S. Cl. ..... 33/566; 33/17 R; 112/475.08

(58) Field of Classification Search ..... 33/566, 33/2 R, 11, 12, 17 R; 112/475.08
See application file for complete search history.

(56) References Cited

U.S. PATENT DOCUMENTS

| | | | | | |
|---|---|---|---|---|---|
| 2,068,684 | A * | 1/1937 | Kravitz | 33/12 |
| 2,131,390 | A * | 9/1938 | Rosenfeld | 33/12 |
| 4,053,986 | A * | 10/1977 | Axelrod | 33/17 R |
| 4,646,666 | A * | 3/1987 | Burrier | 112/475.08 |
| 4,912,850 | A * | 4/1990 | Gray | 33/1 G |
| 5,282,317 | A * | 2/1994 | Carter et al. | 33/1 B |
| 6,925,724 | B2 * | 8/2005 | Tandy | 33/566 |
| 7,281,337 | B1 * | 10/2007 | Oehlke et al. | 33/566 |

* cited by examiner

*Primary Examiner*—Christopher W Fulton
(74) *Attorney, Agent, or Firm*—Nixon Peabody, LLP

(57) ABSTRACT

This invention relates to a removable gridded stabilizer and a method for producing accurately sewn piecework. More specifically, the method involves the use of a removable stabilizer having a grid onto which pieces of fabric may be aligned, adhered, and sewn. Fabric pieces may be adhered into place according to the grid spaces of the stabilizer, then the stabilizer may be folded along the grid lines and sewn with a seam allowance. After sufficient pieces have been sewn together, the stabilizer may be removed.

2 Claims, 5 Drawing Sheets

GRIDDED STABILIZER AND METHOD OF USING SAME

RELATED PATENT APPLICATION

This application claims the benefit under 35 U.S.C. § 119 (e) of U.S. provisional patent application Ser. No. 60/660,445, filed 11 Mar. 2005, by Catherine R. Geier, entitled "Fold Sew Easy-Tear Away Stabilizer A New Approach To Piecing Using a Gridded Tear-Away Stabilizer," which is incorporated herein by reference in its entirety.

FIELD OF THE INVENTION

This invention relates to a removable gridded stabilizer and a method for producing accurately sewn piecework. More specifically, the method involves the use of a removable stabilizer having a grid onto which pieces of fabric may be aligned, adhered, and sewn. Fabric pieces may be adhered into place according to the grid spaces of the stabilizer, then the stabilizer may be folded along the grid lines and sewn with a seam allowance. After sufficient pieces have been sewn together, the stabilizer may be removed.

BACKGROUND OF THE INVENTION

There are many instances in which it is desirable to join fabric pieces together by way of a seam such that the right or front sides of the joined fabric pieces face the same way, and the wrong or back sides face the same way. In these instances, the seam allowances or edges along which the seam was formed appear only from the back side. This is typical where, for example, piecework is done to form quilts, quilt covers, decorative pillows, wall hangings, portions of clothing such as vest backs, and the like.

Methods for sewing together pieces of fabric or cloth to create a larger, attractively designed fabric piecework composed of the smaller pieces can involve a greater deal of work. In larger works such as quilts, particularly "watercolor quilts" made of small fabric squares pieced and sewn to create the look of a painting, there can be literally hundreds of pieces which require cutting and placing. Even with great care, the small pieces may be cut with slight variations, and seams must be pinned and perhaps re-pinned many times before the look is complete.

Using current techniques, once the pieces are cut they are sewn together, one piece to another. It requires great care to see that the pieces fit together correctly, because slight errors in seam allowances or measurements tend to throw off the positioning of neighboring pieces and can have a detrimental effect on the overall appearance and size of the finished product. When sewing pieces together, one generally does not have any drawn line to sew over; it is simply a matter of skill and judgment to see that the seams are sewn straight, and are the proper distance from the edges of the fabric pieces.

Hence, one of the most tedious aspects of creating a large piecework such as a watercolor quilt is the placement and sewing of the individual pieces. Use of a textile, often called a stabilizer or foundation may be used, upon which the individual fabric pieces are sewn. Fusible stabilizers are not advantageous, however, because they have a bias stretch to one side. In large pieceworks, this results in a flawed piecework having curved seams. Fusible stabilizers also leave bulk in the seam allowances.

Moreover, current stabilizer products do not have a grid or pattern drawn or imprinted upon them, so that placing and sewing pieces still requires much tedious work. Thus, there remains a need for an improved stabilizer and method of using it that would allow for a faster piecework method, and provide for a better piecework product.

SUMMARY OF THE INVENTION

An object of the present invention provides for a removable fabric stabilizer with a grid drawn or printed on it, to which pieces of fabric may be arranged, adhered, and sewn before the stabilizer is removed.

Another object of the invention provides for a method of using a gridded stabilizer to make a piecework comprising the steps of: obtaining a stabilizer with a grid drawn or printed on it, obtaining fabric pieces slightly smaller than the grid squares, arranging the fabric pieces on the stabilizer, affixing the fabric pieces onto the stabilizer, folding the stabilizer along the grid lines such that the fabric pieces face each other, sewing the fabric pieces and stabilizer from the back, and removing the stabilizer from the sewn pieces.

In one embodiment of the present invention, the stabilizer is printed with a grid of horizontal and vertical lines to form a pattern of squares. In another aspect of the invention, the grid is further printed with diagonal lines to form triangles within the squares. In another embodiment of the invention, the grid lines are printed in a diagonal fashion to form squares on-point.

DETAILED DESCRIPTION OF THE INVENTION

Figure 1:
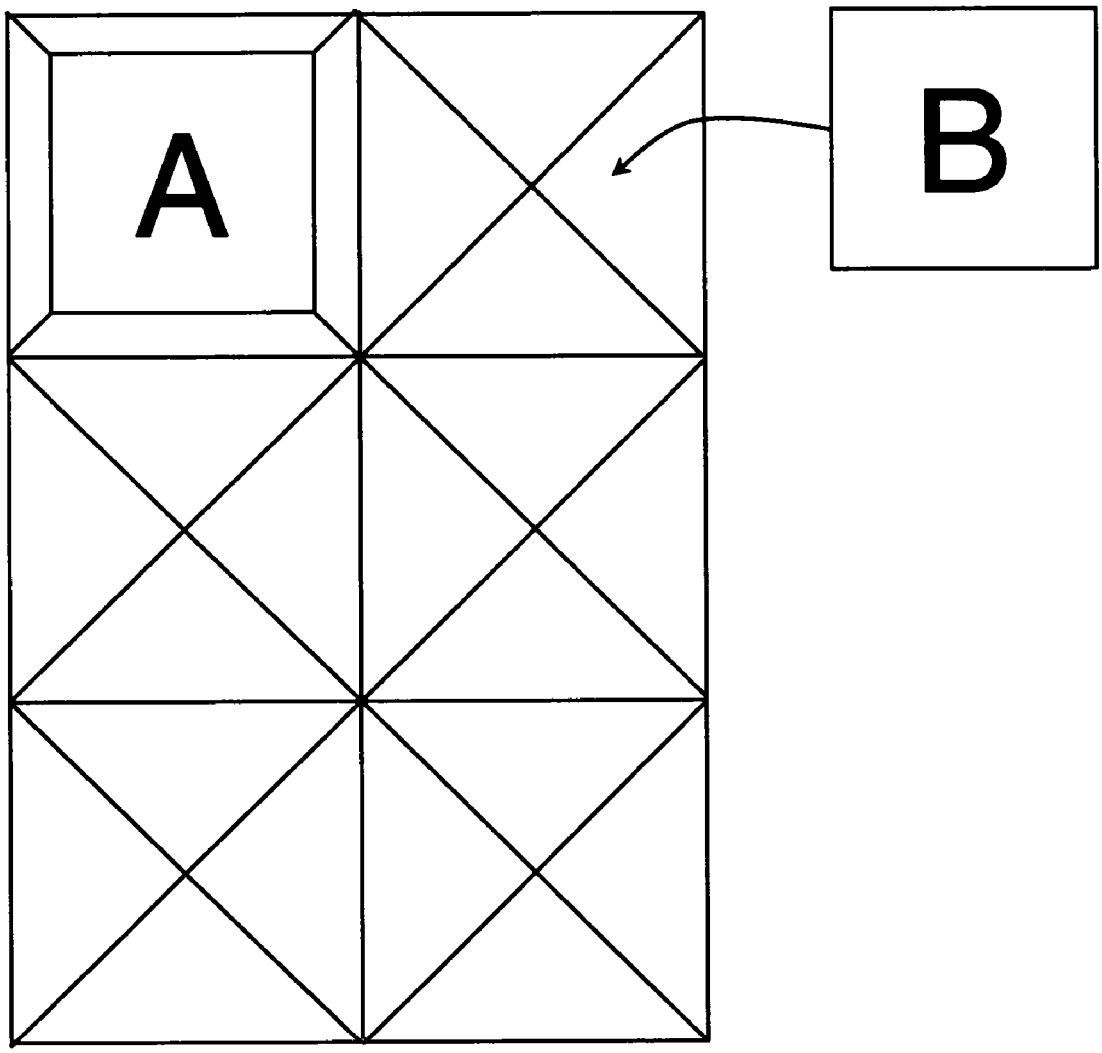
FIG. 1 depicts a piece of stabilizer with an embodiment of a grid pattern on to which fabric pieces may be adhered.

It should be understood that this invention is not limited to the particular embodiments, methodology, etc., described herein and as such may vary. The terminology used herein is for the purpose of describing particular embodiments only, and is not intended to limit the scope of the present invention, which is defined solely by the claims.

As used herein and in the claims, the singular forms "a," "an," and "the" include the plural reference unless the context clearly indicates otherwise. Thus, for example, the reference to a fabric piece is a reference to one or more such pieces, including equivalents thereof known to those skilled in the art.

All patents and other publications identified are incorporated herein by reference for the purpose of describing and disclosing, for example, the methodologies described in such publications that might be used in connection with the present invention. These publications are provided solely for their disclosure prior to the filing date of the present application.

Nothing in this regard should be construed as an admission that the inventor is not entitled to antedate such disclosure by virtue of prior invention or for any other reason.

Unless defined otherwise, all technical terms used herein have the same meaning as those commonly understood to one of ordinary skill in the art to which this invention pertains. Although any known methods, devices, and materials may be used in the practice or testing of the invention, the preferred methods, devices, and materials in this regard are described here.

The present invention relates to a removable fabric stabilizer with a grid for aligning fabric pieces and sewing fabric pieceworks. More specifically, the present invention provides for a fabric stabilizer marked with a grid pattern, wherein the grid may be horizontal squares, on-point squares, or squares further divided into triangles.

The present invention also relates to a method of making a complex fabric piecework by obtaining a gridded stabilizer, obtaining fabric pieces slightly smaller than the grid squares, arranging the fabric pieces on the stabilizer, affixing the fabric pieces onto the stabilizer, folding the stabilizer along the grid lines such that the fabric pieces face each other, sewing the fabric pieces and stabilizer from the back, and removing the stabilizer from the sewn pieces.

The stabilizer of the present invention is any suitable textile that holds its shape, folds on precise creases, and tears away easily from the sewn piecework. Also called "foundation," such textiles are often used to stabilize machine embroidery work. Heavy or thick stabilizers may be too hard to work with according to the methods of the present invention. Wash-away stabilizers may be used for smaller pieceworks. Suitable stabilizers are available commercially, such as, for example, Ultra Clean and Tear (Oklahoma Embroidery Supply & Design, Inc., Oklahoma City, Okla.) or Foundations Medium Tear-Away (Hammer Brothers, Inc. Kansas City, Mo.). One of ordinary skill in the art, in light of the present specification, may determine which stabilizer is suitable without undue experimentation.

The size of the gridded stabilizer may be any size, in squares or rolls of various height and length. In the method of the present invention, pieces of stabilizer may be joined together to achieve the desired piecework size. Similarly, stabilizer may be cut to smaller pieces as the user desires.

The gridded stabilizer of the present invention is a stabilizer upon which a grid has been drawn or printed, and such printing may take place either during or subsequent to the fabrication of the stabilizer. The grid of the present invention refers to a pattern of regularly spaced horizontal and vertical lines forming squares. Alternatively, the grid may be comprised of diagonal lines forming squares on point. Additionally, the horizontal or on point squares may be subdivided into triangles by the addition of lines crossing the squares from corner to corner which may appear in a diagonal orientation. Users may also add additional more intricate sewing lines in whatever patterns they choose, for example, adding rectangles or scalene triangles. The size of the grid, as well as the size of the gridded stabilizer, may be any suitable size as the user desires.

The grid may be drawn on the stabilizer in ink that does not run, for example, ball-point pen, such that the grid lines are visible through or on both sides, albeit lightly on one side, of the stabilizer. A ruler or similar straight edge may be used to assure that grid lines are substantially evenly spaced and substantially straight. Alternatively, the grid is printed on rolls of stabilizer by a commercial printer by methods known in the art.

The fabric pieces of the present invention may be cut slightly smaller than the grid squares of the gridded stabilizer. Any fabric suitable for quilting as known in the art is suitable for the method of the present invention. For example, some quilters prefer to use only cotton fabrics. The fabric pieces are cut slightly smaller than the squares on the gridded stabilizer: the object of this sizing ratio is to provide minimum excess seam (seam allowances) in the stabilizer when the pieces are sewn together using the grid line and sewing machine foot as guides. For example, the grid squares may be 2¼ inches by 2¼ inches, in which case the fabric pieces may be cut in squares approximately 2⅛ inches by 2⅛ inches. In the instance where the grid size is a 4 inch square, the fabric piece would be cut at about 3⅞ inches.

The fabric pieces may be starched and pressed before being cut to ease handling. Fabric pieces may be cut, for example, into squares, from strips of fabric. Watercolor quilts as exhibited at, for example, http://www.cathygeier.freeservers.com (visited 2005) are made from fabric pieces cut into predominantly into square pieces. According to the user's design, not all fabric pieces must be squares: there may be triangles, rectangles, or other shapes that may be used in the method of the present invention.

Once the gridded stabilizer and fabric pieces have been obtained, the user may arrange the fabric pieces on the stabilizer according to a plan and/or inspiration. The fabric pieces are arranged such that the back of the fabric piece sits within the center of a grid on the front of the gridded stabilizer. The user may thus create the image as it will appear in the finished piecework, rather than a reverse or mirror image of the piece. The user may make use of a design wall such as a foam insulation panel, or any large space that allows perspective viewing of the piecework as layout continues.

Additionally, more than one piece of fabric may be positioned against the stabilizer to create a more 3-dimensional look to portions of the piecework as the user desires. Such 3-dimensionality may be created by placing the various fabric pieces on the gridded stabilizer surface in particular arrangements. For example, in creating triangles or rectangles the first piece portion of the fabric placed on the stabilizer will appear to be behind the second piece placed over it.

The fabric pieces are then affixed to the stabilizer by any appropriate method. For example, acid-free paper glue sticks provide a suitable substance for adhering the fabric squares to the stabilizer. Commercially available glue sticks suitable for the present method include, e.g., Ross® Stik or Scotch® Glue Stick. Alternatively, straight pins may be used to affix the fabric pieces to the gridded stabilizer. The user may initially use stick pins poked through the fabric, stabilizer, and into a foam design wall which allows for easy rearranging, and then glue the fabric pieces in place before sewing. The fabric pieces are affixed substantially in the center of each grid square of the gridded stabilizer.

Sufficient glue should be used to keep the fabric pieces affixed during the sewing process. On the other hand, because the stabilizer may be removed ultimately, excessive amounts of glue should be avoided. Additionally, the user may avoid placing glue immediately next to the grid line, as this may interfere with seam allowances and stabilizer removal. Once the design layout is in place and affixed, the user may inspect the stabilizer sections and cut away any excess fabric that overlaps the grid lines.

The gridded stabilizer may then be folded along a grid line such that the front side (or right side) of the fabric pieces in immediately adjacent rows face each other and the grid line is creased along the back of the stabilizer. In the instance where stabilizer pieces are joined together in making a larger piecework, the first fold should be parallel to the next section of stabilizer to be joined.

The stabilizer may then sewn such that the crease is aligned with the edge of the sewing machine foot. If the sewing is done by hand, the stitches should be places approximately ¼ inch from the creased grid line. In this fashion, the seam allowance in the stabilizer is greater than the seam in the fabric pieces, and an entire row of fabric pieces is sewn at once. This has the advantage over traditional approaches in which pieces were sewn to each other one piece at a time. When using a sewing machine, it may be set to sew tiny stitches employing a large size needle (90/14), which will make tearing away stabilizer an easier process.

The next stabilizer grid line, parallel to the first, may then be folded in the same fashion: with the front or right side of fabric pieces facing each other. This row may then be sewn with the creased grid line aligned with the sewing machine foot to create a seam allowance, or sewn by hand at approximately ¼ inch from the creased grid line. This process may continue until all the parallel rows have been folded and sewn. Viewing the front (or right side) of the piecework, one sees a continuous seam along each row where the pieces have been sewn to each other and the stabilizer, and perpendicular rows where stabilizer grid lines are still visible. Viewing the back (or wrong side) of the piece, one sees rows of seam allowance loops at the sewn grid lines and perpendicular grid lines visible on the unsewn stabilizer. These loops of stabilizer are then slit with any conventional tool such as a sharp scissors, and the excess stabilizer removed from the seam. The remaining stabilizer may be left affixed to the fabric because the remaining rows (perpendicular to the sewn rows) are yet to be folded and sewn.

The seams may be pressed closed, right sides together, to set the seam. Pressing opposing rows allows seam allowances to be evenly distributed. Such pressing methods are well known in the art. Heavy steam, which may reactivate glue or dissolve wash-away stabilizer, should be avoided.

The piecework may then be repositioned, such that the grid lines (perpendicular to the rows already completed) are folded and sewn, and the stabilizer loops of the seam allowance slit and removed.

When creating a large piecework, several pieces of gridded stabilizer may be joined together. This may be achieved by cutting the edges of stabilizer to be joined along the grid line at the connection point. The two pieces are then aligned facing each other, as if the cut edges were a fold, and pinned together. By sewing a ¼ inch seam and removing the stabilizer from the seam allowance, the pieces are joined in a fashion that looks, from the front, identical to the rest of the sewn rows.

After the all the grid lines have been folded, sewn, and the stabilizer removed from the seam allowance, the remaining stabilizer may be left in place while the user completes borders or appliqué or the like. Alternatively, the user may wish to remove the excess stabilizer as soon as possible to avoid the glue bonding with the fabric such that it is difficult to remove the glue and stabilizer. Washing the piecework in water generally dissolves remaining glue.

When applying appliqué, the user may leave the stabilizer in place as the appliqué is positioned and glued or ironed on, but the stabilizer may then be removed before the appliqué is sewed into place.

The method of the present invention may also be combined with other methods of creating pieceworks, such as the paper piecing style method. See, e.g., U.S. Pat. No. 4,646,666. For example, triangles may be sewn together by the paper piecing approach. As such, they are affixed to the grid of the present invention and sewn into the piecework. Additionally, once the initial piecework is assembled, other textiles or beads may be appliquéd or sewn onto the piecework as well.

The invention will now be described further by non-limiting examples.

EXAMPLES

Example 1

Simple Square Piecework

Figure 2:
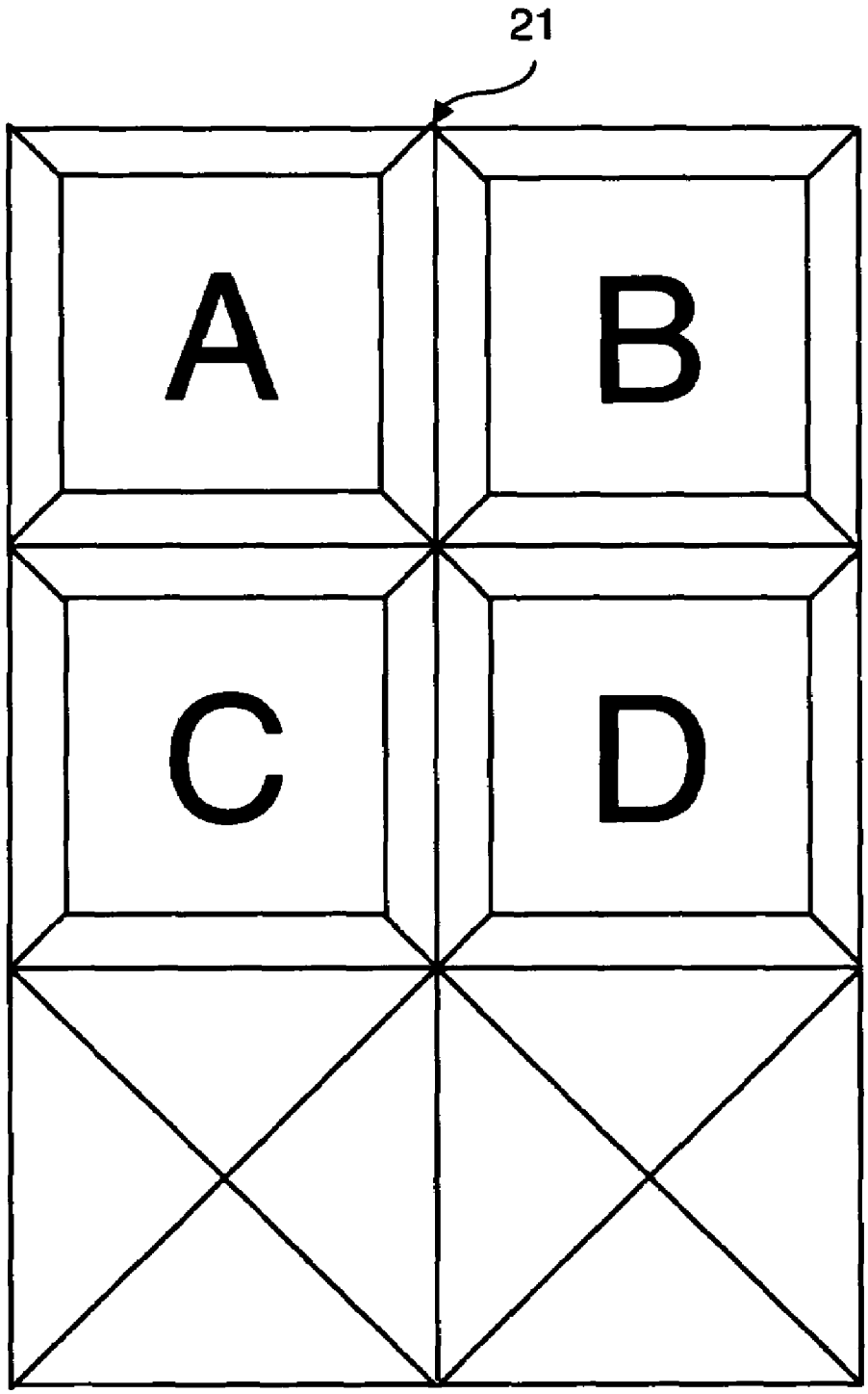
FIG. 2 depicts a piece of gridded stabilizer to which fabric pieces have been adhered, indicating a vertically-oriented fold line of the stabilizer.

A grid may be drawn or otherwise obtained on a piece of stabilizer that includes vertical, horizontal, and optionally diagonal lines. As depicted in FIG. 1, a piece of fabric A, slightly smaller than the grid square, is adhered generally within the center of a grid of the gridded stabilizer. The arrow in FIG. 1 indicates the placement of a second fabric piece B into a second grid square. In a similar fashion, fabric squares C and D are adhered into place in grid squares as shown in FIG. 2. The remainder of the gridded stabilizer is left unfilled in this Example, and the grid lines remain visible in FIG. 2.

Figure 3:
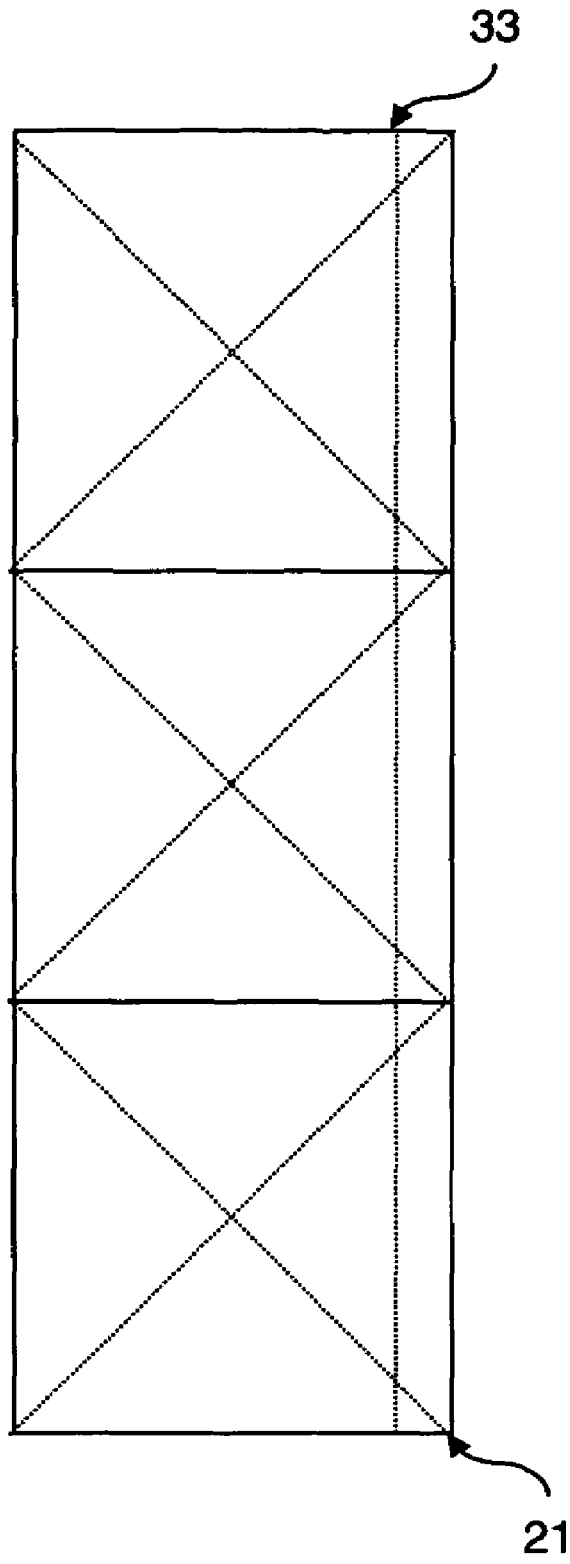
FIG. 3 depicts a piece of gridded stabilizer folded for sewing or stitching.

Once fabric pieces A, B, C, and D have been adhered, the stabilizer is folded along vertical line 21, such that the fabric pieces face each other. A view of the back of the stabilizer, folded along line 21, is depicted in FIG. 3. Then, the folded stabilizer is sewn along line 33, parallel to line 21. Line 33 is not drawn on the stabilizer, as the foot of the sewing machine, following the fold of line 21, creates this seam.

Figure 4:
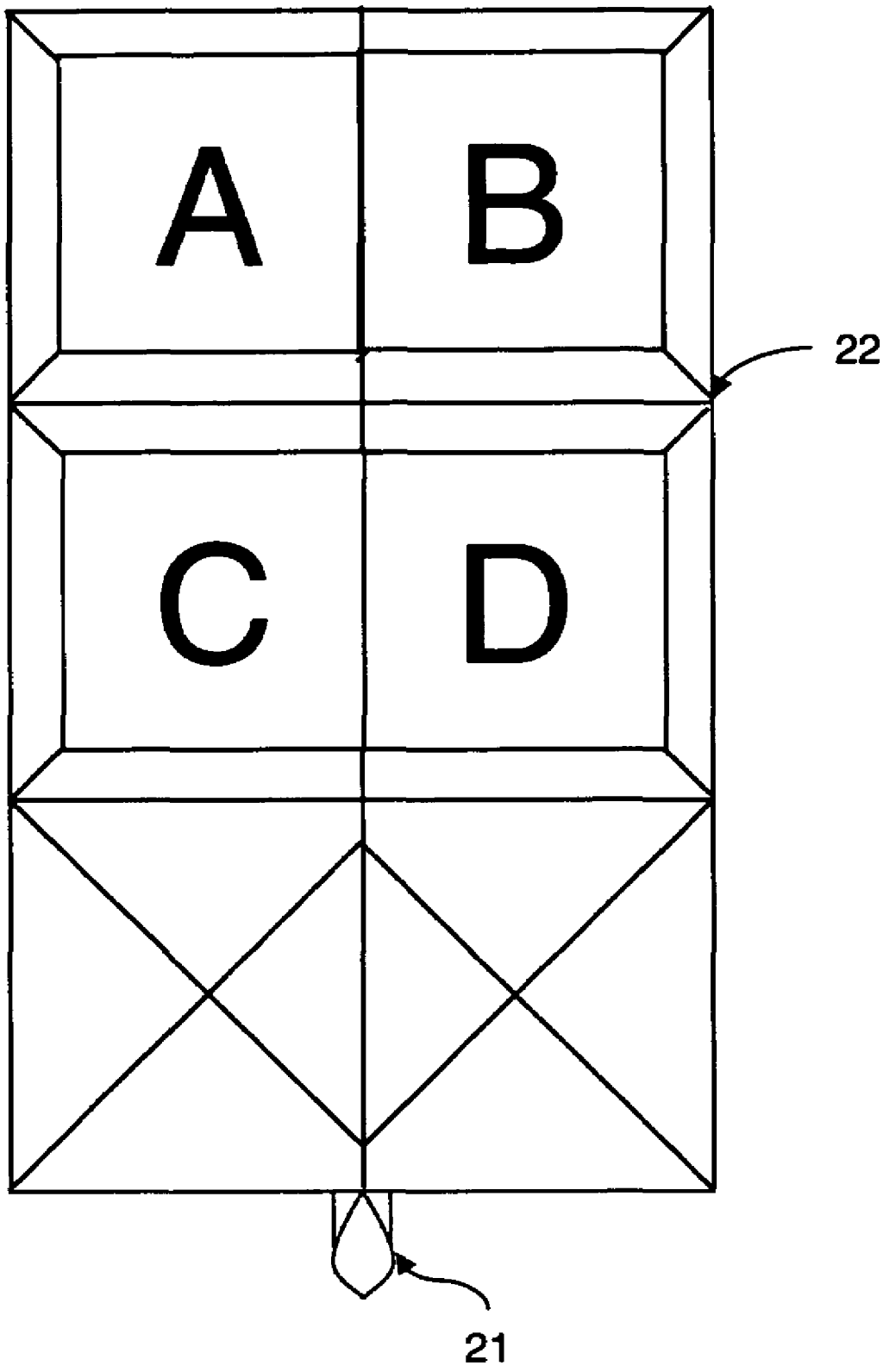
FIG. 4 depicts a piece of gridded stabilizer and fabric pieces sewn in one (vertical) direction, showing excess stabilizer and a seam, and indicating a horizontal-oriented fold line.
Figure 5:
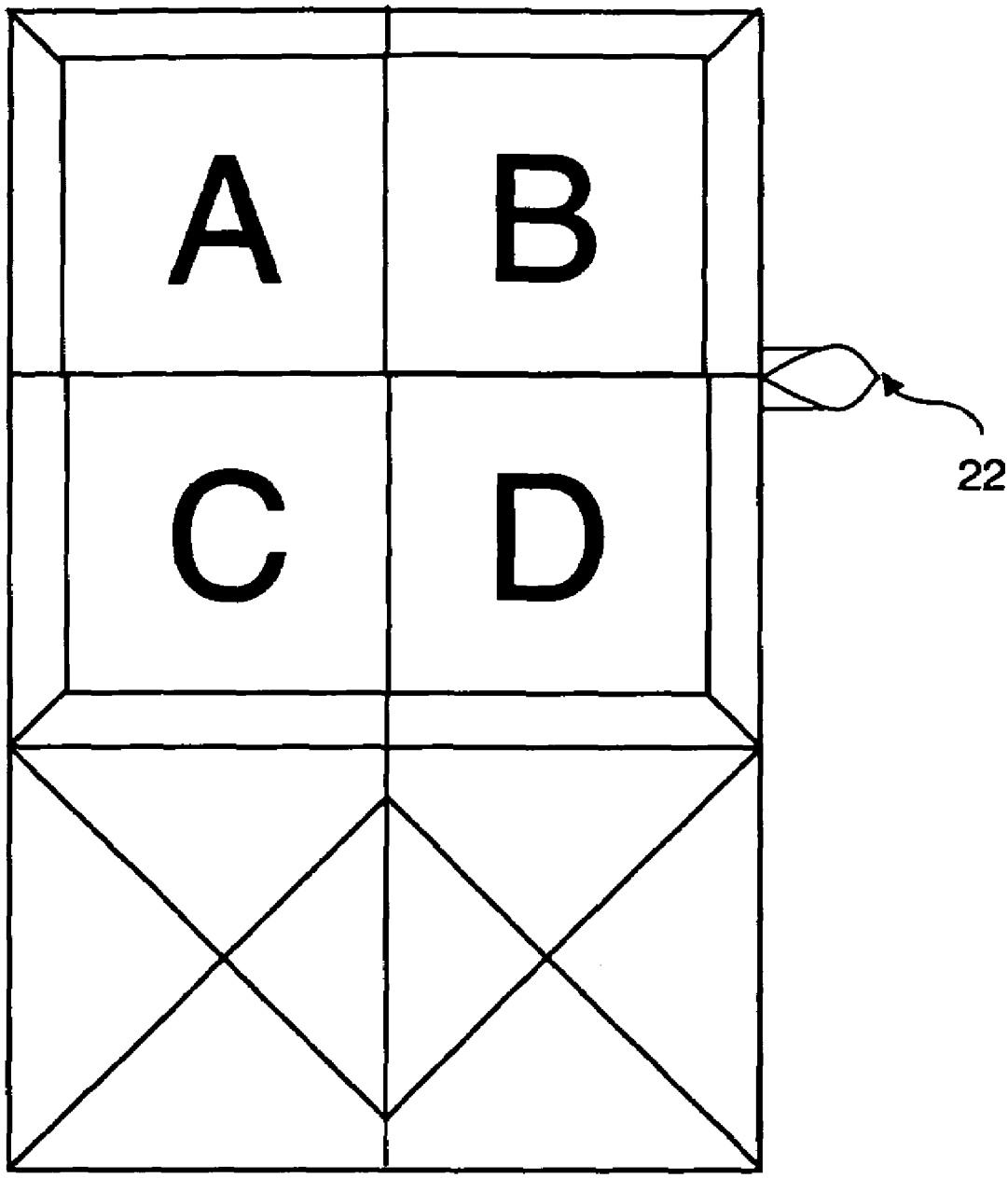
FIG. 5 depicts a piece of gridded stabilizer with attached fabric pieces which has been sewn in two (vertical and horizontal) directions, showing that all fabric pieces are joined together.

Once the seam along line 33 has been created, the excess stabilizer, still including line 21, may be removed. Fabric piece A is now connected to piece B, and fabric piece C is connected to piece D. FIG. 4 depicts this stage of the piecework, and indicates horizontal line 22, which may then be folded and sewn. FIG. 5 illustrates the piecework after a seam has been sewn following a fold along line 22. Fabric pieces A, B, C, and D are now connected to each other, and the excess stabilizer containing line 22, may be removed. Additional stabilizer may also be removed. This simple four-piece piecework may be included in a larger piecework, or finished as the user sees fit.

What is claimed is:

1. A method of creating a fabric piecework comprising the steps of: obtaining a lined stabilizer wherein the lines are either arranged horizontally and vertically to form a grid of squares or arranged diagonally in a criss-cross fashion to form a grid of squares on-point, obtaining fabric pieces slightly smaller than the grid squares or squares on-point, arranging the fabric pieces on the stabilizer, affixing the fabric pieces onto the stabilizer, folding the stabilizer along the grid lines such that the fabric pieces face each other, sewing the fabric pieces and stabilizer from the back, and removing the stabilizer from the sewn pieces.

2. The method of claim 1, wherein at least one grid square or square on-point is further divided by diagonal lines to form at least one triangle within the square or square on-point.

* * * * *